US007287994B1

(12) United States Patent
Liao

(10) Patent No.: US 7,287,994 B1
(45) Date of Patent: Oct. 30, 2007

(54) MODULAR PLUG DEVICE

(76) Inventor: Sheng-Hsin Liao, No. 10, Alley 38, Lane 229, San Chun St., Shulin City, Taipei Hsien (TW)

( * ) Notice: Subject to any disclaimer, the term of this patent is extended or adjusted under 35 U.S.C. 154(b) by 0 days.

(21) Appl. No.: 11/783,761

(22) Filed: Apr. 12, 2007

(51) Int. Cl.
*H01R 29/00* (2006.01)

(52) U.S. Cl. ..... 439/172; 439/352

(58) Field of Classification Search ..... 439/170, 439/369, 352, 357

See application file for complete search history.

(56) References Cited

U.S. PATENT DOCUMENTS

| | | | | |
|---|---|---|---|---|
| 4,136,918 | A * | 1/1979 | Claesson et al. | 439/172 |
| 4,875,874 | A * | 10/1989 | Windsor, Jr. | 439/369 |
| 5,613,863 | A * | 3/1997 | Klaus et al. | 439/131 |
| 6,056,580 | A * | 5/2000 | Cross et al. | 439/369 |
| 6,364,715 | B1 * | 4/2002 | Liu et al. | 439/638 |
| 6,461,196 | B2 * | 10/2002 | Wilson et al. | 439/633 |
| 6,695,637 | B1 * | 2/2004 | Liu | 439/377 |
| 6,935,877 | B2 * | 8/2005 | Liao | 439/170 |
| 6,957,977 | B1 * | 10/2005 | Miller | 439/369 |
| 7,108,562 | B2 * | 9/2006 | Liao | 439/676 |
| 7,189,089 | B1 * | 3/2007 | Liao | 439/170 |
| 2007/0111608 | A1 * | 5/2007 | Huang | 439/676 |

* cited by examiner

*Primary Examiner*—Neil Abrams
*Assistant Examiner*—Phuongchi Nguyen
(74) *Attorney, Agent, or Firm*—Rosenberg, Klein & Lee

(57) ABSTRACT

A modular plug device includes an adapter and a plug. The adapter has an insulating casing and a locking button. The insulating casing has two side arms and is provided with pivoting portions. One side arm is provided a projecting portion on the surface of the inner edge thereof. The locking button is movably provided on the two side arms. The plug is movably assembled with the adapter. The side edges of the plug are formed with sliding grooves to correspond to the pivoting portions. The projecting portions are stopped and positioned by the front ends of the sliding grooves when the inner surface of the locking button abut against the outer surface of the side arm. Therefore, when the plug is assembled with the adapter they can be reliably locked together without the risk of loosening or detaching, thereby achieving a secure electrical connection.

12 Claims, 11 Drawing Sheets

MODULAR PLUG DEVICE

BACKGROUND OF THE INVENTION

1. Field of the Invention

The present invention relates to a modular plug device, and in particular to modular plug device comprising an adapter and a plug slidably assembled with the adapter, whereby a locking function is provided when a power plug is assembled with the adapter.

2. Description of Related Art

When a conventional power line is electrically connected with an electronic device, a power plug connected to one end of the power line is inserted into a corresponding socket on the electronic device. With the electrical connection between the power plug and the socket, the power line can be electrically connected with the electronic device. However, if the power plug and the socket have different specifications or types, it is necessary to first assemble the power plug with an adapter, the adapter can then be inserted into the socket, thereby completing the electrical connection between the power plug and the socket.

However, when the power plug is assembled with the adapter, there is no reliable locking state between the plug and the adapter. Therefore, there is a risk of the connection loosening or detaching, and it is difficult to ensure the electrical connection.

Therefore, in view of this, the inventor proposes the present invention to overcome the above problems based on his expert experience and deliberate research.

SUMMARY OF THE INVENTION

The primary object of the present invention is to provide a modular plug device. With this arrangement, when the plug and the adapter are assembled together, they can be reliably locked without the risk of loosening or detaching, thereby achieving an electrical connection.

In order to achieve the above objects, the present invention provides a modular plug device comprising an adapter having an insulating casing and a locking button. The insulating casing has two side arms and is provided with pivoting portions. At least one side arm is provided with an elastic arm, and the surface of the inner edge of the elastic arm is provided with a projecting portion. The locking button is movably provided on the two side arms. The surface of the inner edge of the locking button is provided with at least one abutting portion. A plug is movably assembled with the adapter. The side edges of the plug are formed with sliding grooves that correspond to the pivoting portions. The projecting portions are stopped and positioned by the front ends of the sliding grooves when the abutting portions abut the surface of the outer edge of the elastic arms.

The present invention further provides a modular plug device comprising an adapter having an insulating casing. The insulating casing has two side arms and pivoting portions. The upper and lower edges of the two side arms are connected to a connecting plate respectively. The surface of the inner edge of at least one side arm is provided with a projecting portion. A plug is movably assembled with the adapter. The side edges of the plug are formed with sliding grooves that correspond to the pivoting portions. The projecting portions are stopped and positioned by the front ends of the sliding grooves.

The present invention has the following advantages. The present invention is provided with projecting portions on the surface of the side edges of the side arms of the insulating casing of the adapter. When the plug is assembled into the insulating casing of the adapter to achieve an electrical connection, the projecting portions can be stopped and positioned by the front ends of the sliding grooves of the side edge of the plug, thereby forming a locking device. Therefore, when the plug is assembled with the adapter, the plus and the adapter can be reliably locked together without the risk of loosening or detaching, thereby ensuring that a secure electrical connection is formed.

In order to better understand the characteristics and technical contents of the present invention, a detailed description thereof will be made with reference to the accompanying drawings. However, it should be understood that the drawings and the description are illustrative but not used to limit the scope of the present invention.

DETAILED DESCRIPTION OF THE PREFERRED EMBODIMENTS

Figure 1:
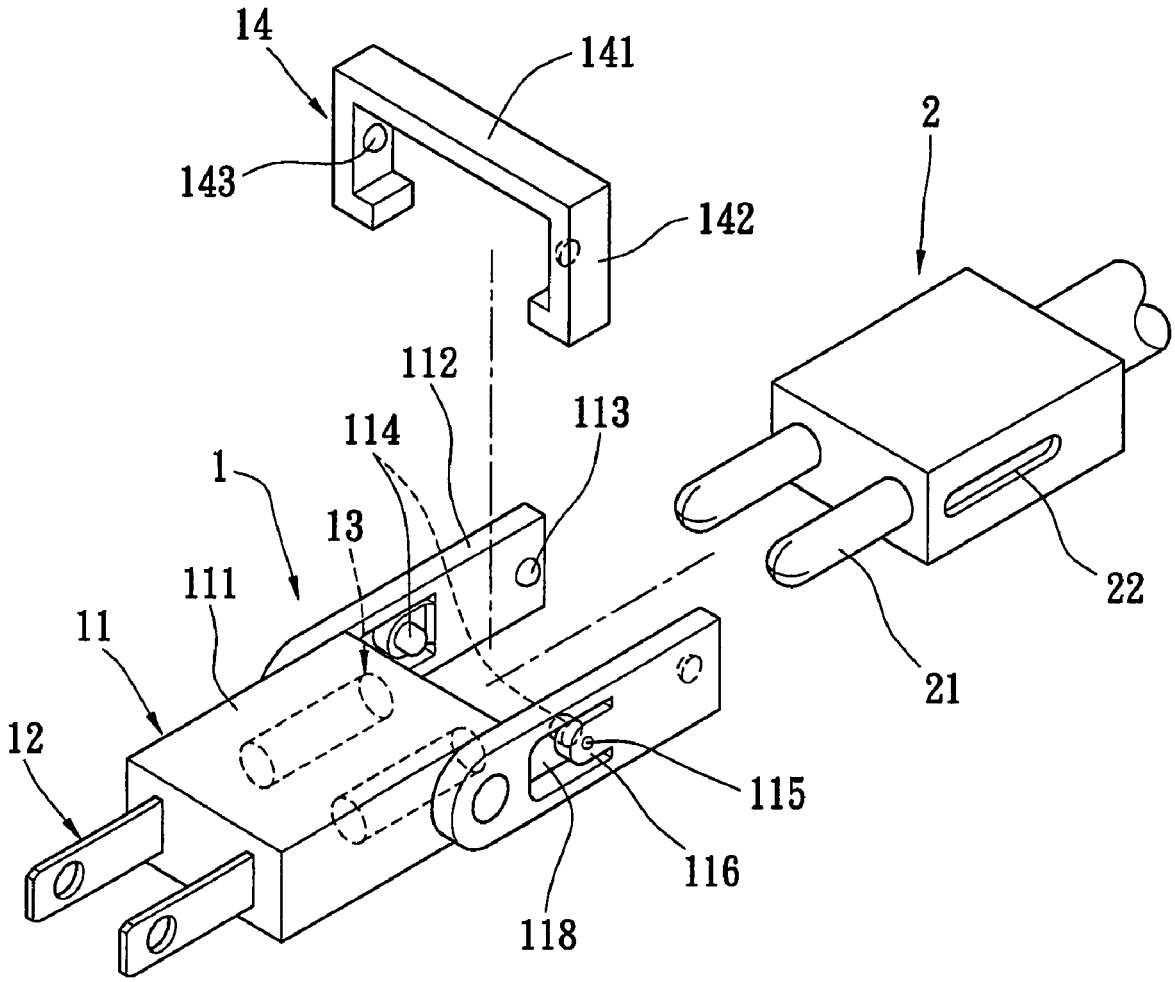
FIG. 1 is an exploded perspective view showing the first embodiment of the present invention.
Figure 2:
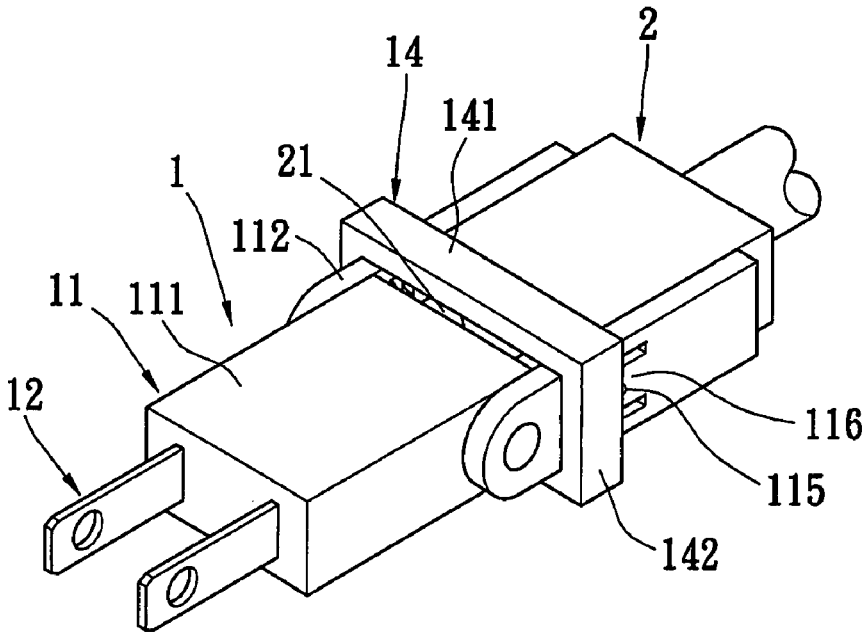
FIG. 2 is an assembled perspective view showing the first embodiment of the present invention.

With reference to FIGS. 1 and 2, the present invention provides a modular plug device, which comprises an adapter 1 and a plug 2. The adapter 1 comprises an insulating casing 11, a first connecting element 12, a second connecting element 13, and a locking button 14. The insulating casing 11 is made of insulating materials such as plastic, and has a body portion 111 and two side arms 112 connected to both sides of the body portion 111. The surface of the inner edge of each side arm 112 is formed with a pivoting portion 113. The pivoting portion 113 is a projecting pillar and is provided on the surface of the inner edge of the side arm 112 far from the body portion 111.

Figure 7:
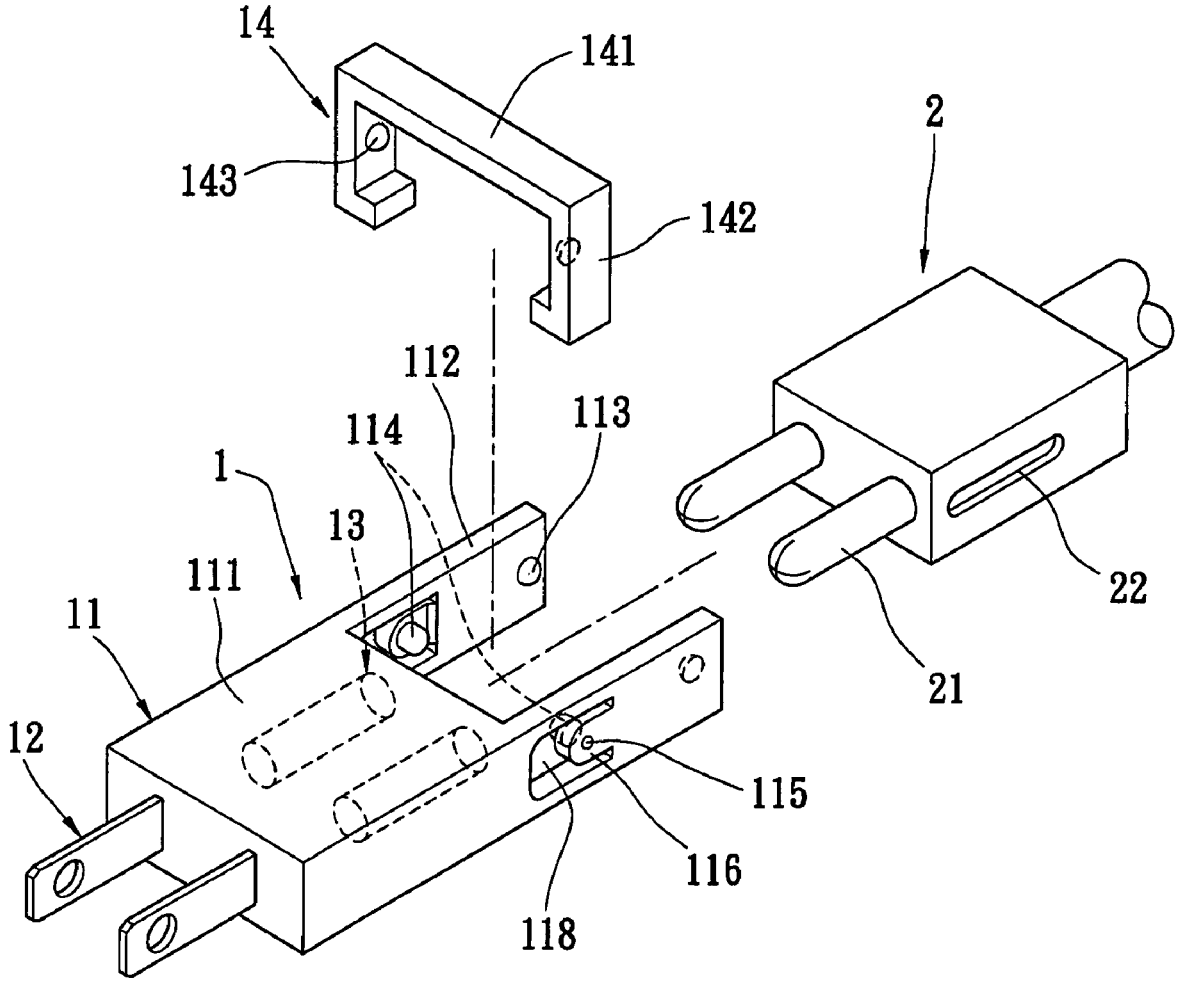
FIG. 7 is an exploded perspective view showing the second embodiment of the present invention.

The two side arms 112 can either rotate or be immobile. In the present embodiment, the two side arms 112 can rotate. That is, the two side arms can be rotatably pivoted to two side edges of the body portion 111 via pivoting pillars so that the two side arms 112 can rotate. Furthermore, as shown in FIG. 7, the two side arms 112 can be immobile. That is, the two side arms 112 are integrally formed with the body portion 111.

Figure 4:
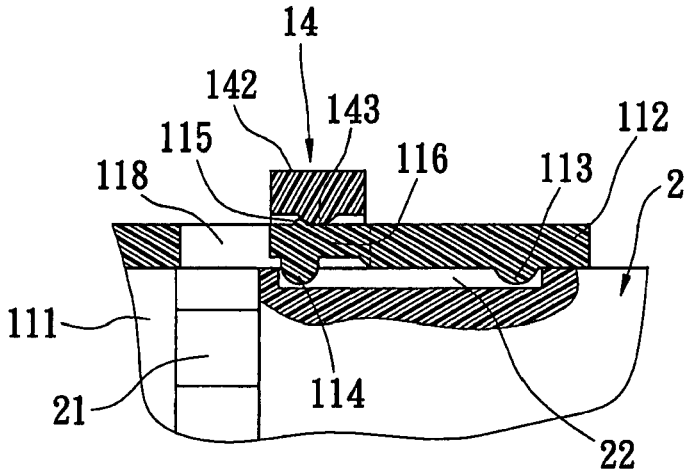
FIG. 4 is a cross-sectional view showing the abutting portion abutting against the surface of the outer edge of the elastic arm in accordance with the first embodiment of the present invention.
Figure 5:
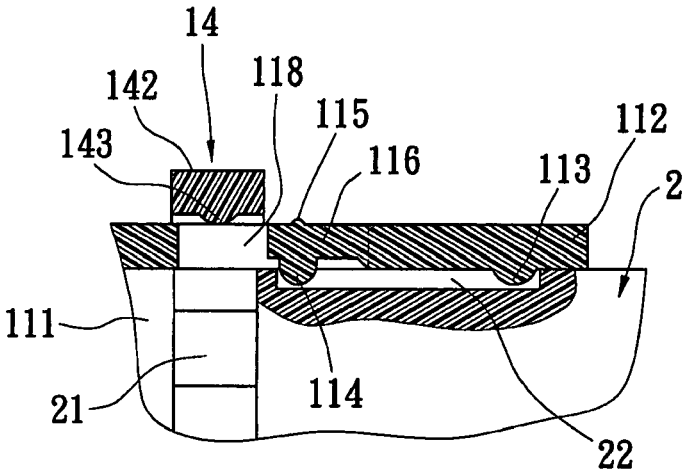
FIG. 5 is a cross-sectional view showing the abutting portion that corresponds to the cut groove in accordance with the first embodiment of the present invention.
Figure 6:
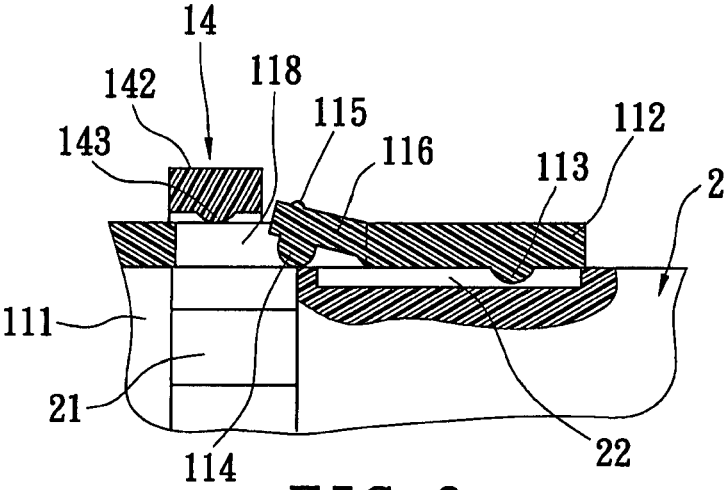
FIG. 6 is a cross-sectional view showing the projecting portion detaching from the sliding groove in accordance with the first embodiment of the present invention.

The two side arms 112 are each formed thereon with an elastic arm 116. The outer periphery of the elastic arm 116 is provided with a cut groove 118 formed into a U-shape. The thickness of the elastic arm 116 is smaller than that of the side arm 112. One end of the elastic arm 116 is fixed to the side arm 112, and the other end is formed into a free end. The surface of the inner edge of the elastic arm 116 is provided with a projecting portion 114, as shown in FIGS. 4 to 6. The projecting portion 114 is provided on the surface of the inner edge of the elastic arm 116 adjacent to the body portion 111. The projecting portion 114 projects from the surface of the inner edge of the elastic arm 116 to a proper height, thereby providing a stopping and positioning function. The elastic arm 116 and the projecting portion 114 on the elastic arm 116 can swing inwardly and outwardly. Further, the surfaces of the outer edges of the two elastic arms 116 are respectively provided with a projecting point 115.

The first connecting element 12 is connected to the front end of the body portion 111 of the insulating casing 11. The second connecting element 13 is connected into the body portion 111 opposite to the first connecting element 12. Further, the first and second connecting elements 12, 13 are electrically connected. Terminals (not shown) are provided between the first and second connecting elements 12, 13, thereby achieving the electrical connection between the first and second connecting elements 12, 13.

The first connecting element 12 has a plurality of conductive pins and can adopt two-pole or three-pole conductive pin according to various specifications and types as they are used in individual countries. For example, the conductive pins used in US, EU, UK or AU may be adopted/used. The specifications and types of the conductive pin are not limited thereto. The locking button 14 is movably provided on two side arms 112 of the insulating casing 11. The locking button 14 has a top plate 141 and two side plates 142 connected to both sides of the top plate 141 respectively. The two side plates 142 are slidably connected to the two side arms 112 so that the locking buttons 14 can be slidably provided on the two side arms 112, thereby controlling the locking device to be locked or released.

The surface of the inner edge of each side plate is provided with an abutting portion 143. The two abutting portions 143 project from the surface of the inner edge of the two side plates 142 to a proper height so that a user can push the locking button 14 to move the two side arms 112 and control the two abutting portions 143 to move along the surface of the outer edge of the side arms 112. In this way, the two abutting portions 143 can abut against the surface of the outer edge of the two elastic arms 116 or correspond to the two cut grooves 118, thereby controlling the locking device to be locked or to be released.

The front end of the plug 2 is provided with a third connecting element 21. The third connecting element 21 can be a two-pole or three-pole conductive pin of various specifications or types as they are used in individual countries. The specification and type of the conductive pin is not limited thereto. The second connecting element 13 is a socket correspondingly connected with the conductive pins of the third connecting element 21.

Both side edges of the plug 2 are recessed inwardly to form a sliding groove 22, respectively. The two sliding grooves 22 horizontally extend to a proper length. The plug 2 is assembled with the adapter 1 in such a manner that the plug can move forwardly and backwardly. The pivoting portions 113 are correspondingly accommodated in the siding grooves 22 so that the plug 2 is movably assembled with the adapter 1. At the same time, the third connecting element 21 of the plug 2 is inserted into the second connecting element 13 to achieve an electrical connection. Via the above arrangement the locking device of the modular plug of the present invention is obtained.

When the plug 2 is assembled in the insulating casing 11 of the adapter 1, the electrical connection between the third connecting element 21 and the second connecting element 13 can be achieved. With the sliding connection between the pivoting portions 113 and the sliding grooves 22, the plug 2 can move between the two side arms 112 when it is not in use, and rotate to different orientations. Therefore, the plug 2 can be singly used without detaching the adapter 1, thereby providing convenience of use.

Figure 3:
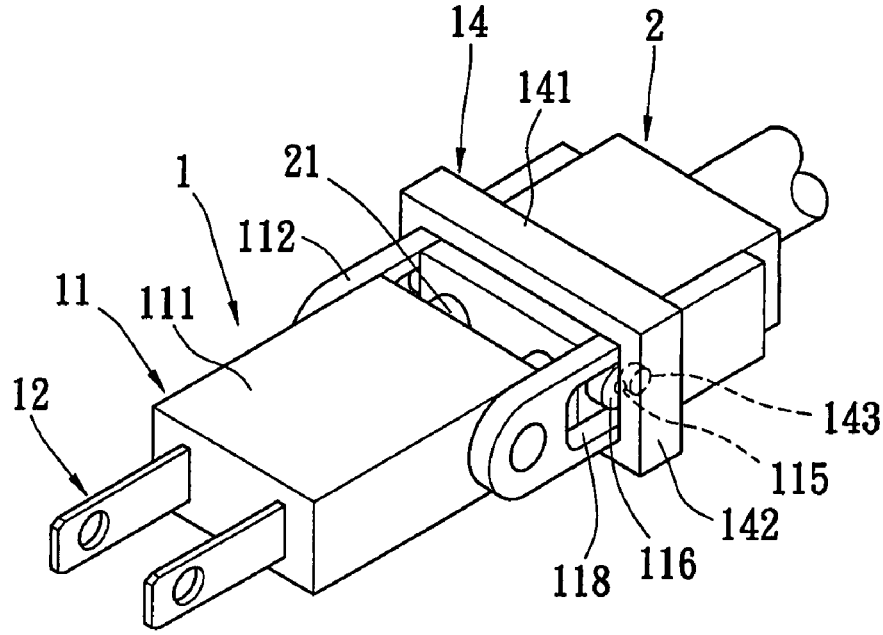
FIG. 3 is a perspective view showing the abutting portion abutting against the surface of the outer edge of the elastic arm in accordance with the first embodiment of the present invention.

In the present invention, a locking button 14 is movably provided on the two side arms 112 of the insulating casing 11, so that the user can push the locking button 14 to move on the two side arms 112, thereby controlling the two abutting portions 143 to abut against the surface of the outer edge of the two elastic arms 116 (FIGS. 3 and 4) or correspond to the two cut grooves 118 (FIG. 5). In this way, the adapter 1 and the plug 2 can be selectively locked or released.

When the plug 2 is assembled and positioned in the insulating casing 11 of the adapter 1, and the third connecting element 21 is electrically connected with the second connecting element 13, the two projecting portions exactly move to the front ends of the two sliding grooves 22. At this time, the user can push the locking button 14 so that the two abutting portions 143 abut against the surface of the outer edge of the two elastic arms 116. Thus, the two elastic arms 116 cannot swing outwardly. That is, the projecting portions 141 can be only located in the sliding grooves 22, and cannot move forwardly to slide out of the sliding grooves 22. Therefore, when the adapter 1 and the plug 2 are departed from each other, the two projecting portions 114 are stopped and positioned by the front ends of the two sliding grooves 22 (FIGS. 3 and 4), thereby forming a locking device. Via this arrangement, when the plug 2 and the adapter 1 are assembled, a reliable locking effect is obtained therebetween without the risk of loosening or departing, thereby achieving the secure electrical connection. If it is applied to medical equipment, better safety can be obtained.

If the locking button 14 is pushed to make the two abutting portions 143 move beyond the projecting points 115 and correspond to the two cut grooves 118 (FIG. 5), the abutting portion 143 can depart from the surface of the outer edge of the elastic arm 116. At the same time, the two elastic arms 116 can swing outwardly, and thus the projecting portions 114 will not be stopped and positioned by the front ends of the sliding grooves 22. The two projecting portions 114 can be detached from the front ends of the sliding grooves 22 (FIG. 6) so that the plug 2 and the adapter 1 can be smoothly detached from each other.

Figure 8:
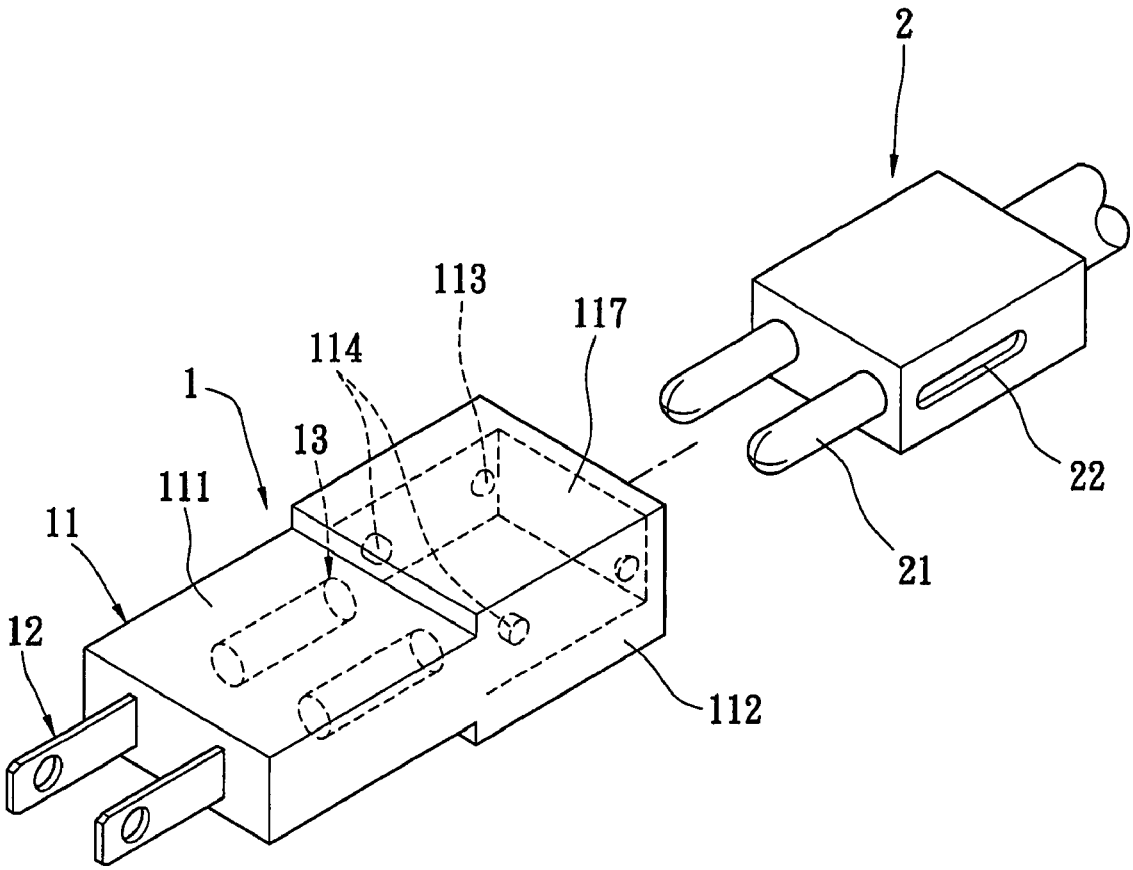
FIG. 8 is an exploded perspective view showing the third embodiment of the present invention.

Further, as shown in FIG. 8, in the present embodiment, the upper and lower edges of the two side arms 112 are connected to a connecting plate 117, respectively. The two side arms 112 and the front ends of the two connecting plates 117 are connected to the body portion 111, respectively. The two side arms 112 and the two connecting plates 117 are used to form a casing with four sides closed. The closed casing is formed with an opening at the end far from the body portion 111, thereby allowing the assembling of the plug 2. The two projecting portions 114 are provided on the surface of the inner edge of the two side arms 11 of the closed casing. Since the connecting plates 117 are connected between the two side arms 112 the rigidity of the two side arms 112 can be increased, and thus the above-mentioned locking button 14 can be omitted.

When the plug 2 is assembled and positioned in the insulating casing 11 of the adapter 1, and the third connecting element 21 is electrically connected with the second connecting element 13, the user only needs to apply a force to make the two projecting portions 114 get into the front ends of the two sliding grooves 22. Since the two side arms 112 are connected with two connecting plates 117, the two side arms cannot swing outwardly. In this way, the two projecting portions 114 can be stopped and positioned by the front ends of the two sliding grooves 22, thereby forming a locking device. Thus, when the plug 2 is assembled with the adapter 1, a reliable locking effect can be obtained therebetween.

When the plug 2 is to be detached from the adapter 1, the user only needs to apply a force so that the two projecting portions 114 can be detached from the front ends of the sliding grooves 22, thereby separating the plug 2 from the adapter 1.

Figure 9:
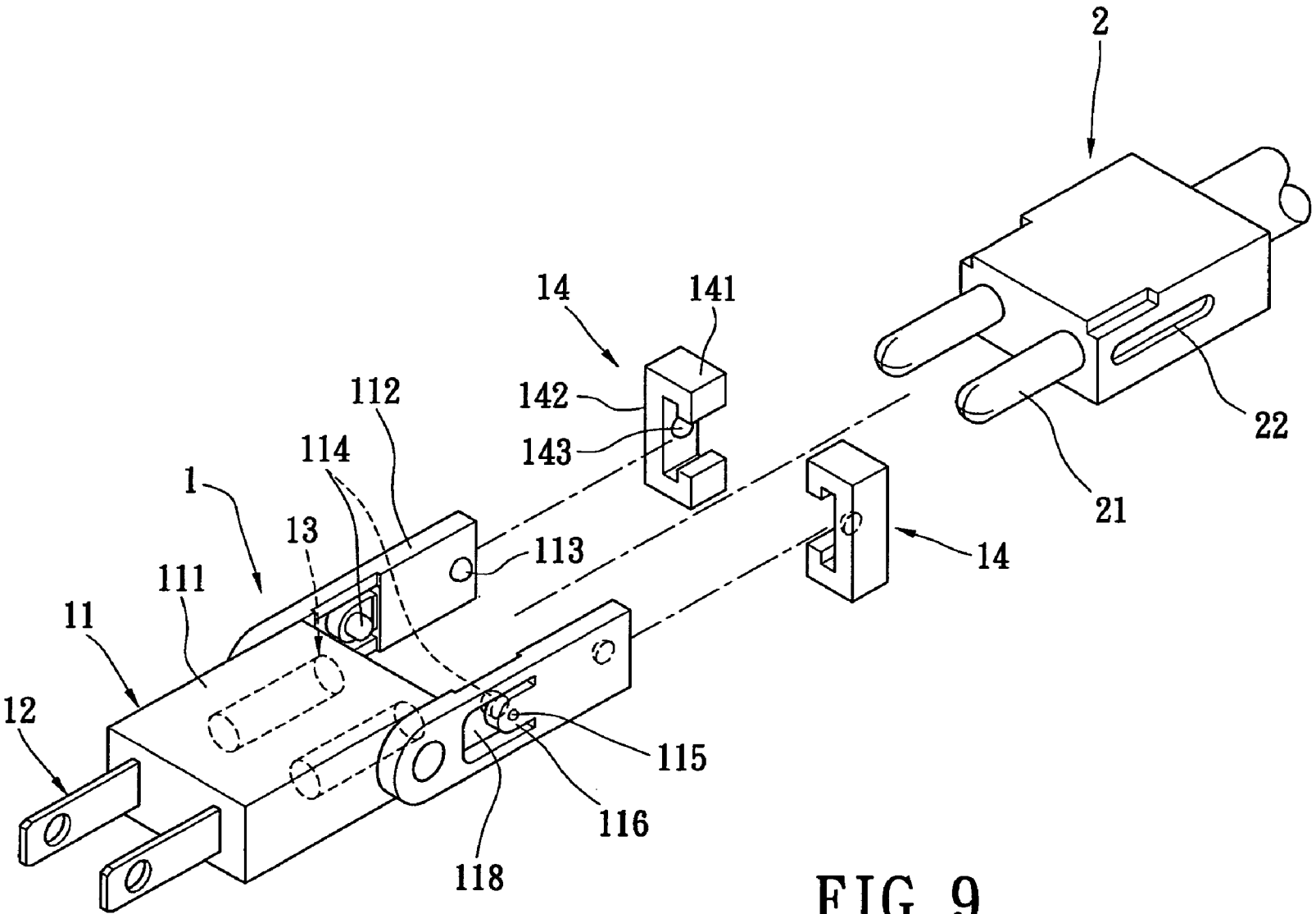
FIG. 9 is an exploded perspective view showing the fourth embodiment of the present invention.

Further, as shown in FIG. 9, in the present embodiment, there are two locking buttons 14. The two locking buttons 14 can be movably provided on the two side arms 112, respectively. Each surface of the inner edge of the locking button 14 is provided with an abutting portion 143. The abutting portion 143 abuts against the surface of the outer edge of the elastic arm 116 or corresponds to the cut groove 118.

Figure 10:
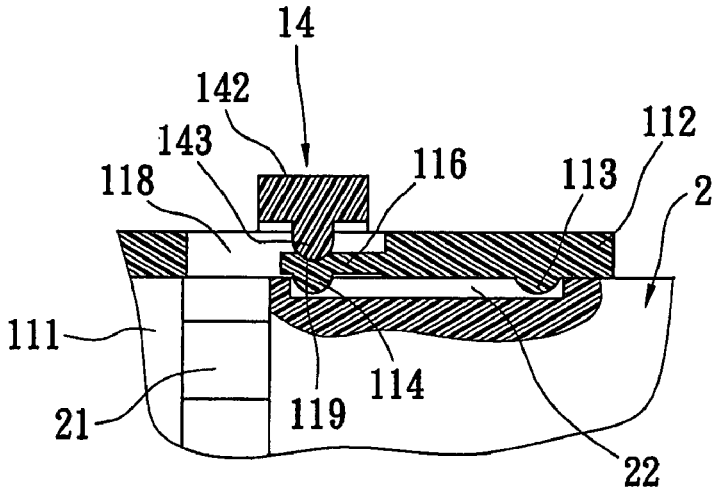
FIG. 10 is a cross-sectional view showing the abutting portion abutting against the surface of the outer edge of the elastic arm in accordance with the fifth embodiment of the present invention.

Further, as shown in FIG. 10, in the present embodiment, the elastic arm 116 is provided with a recessed point 119 on the surface of the outer edge. When the abutting portion 143 of the locking button 14 abuts against the surface of the outer edge of the elastic arm 116, the abutting portion 143 can be exactly positioned in the recessed point 119, thereby firmly positioning the locking button 14.

Figure 11:
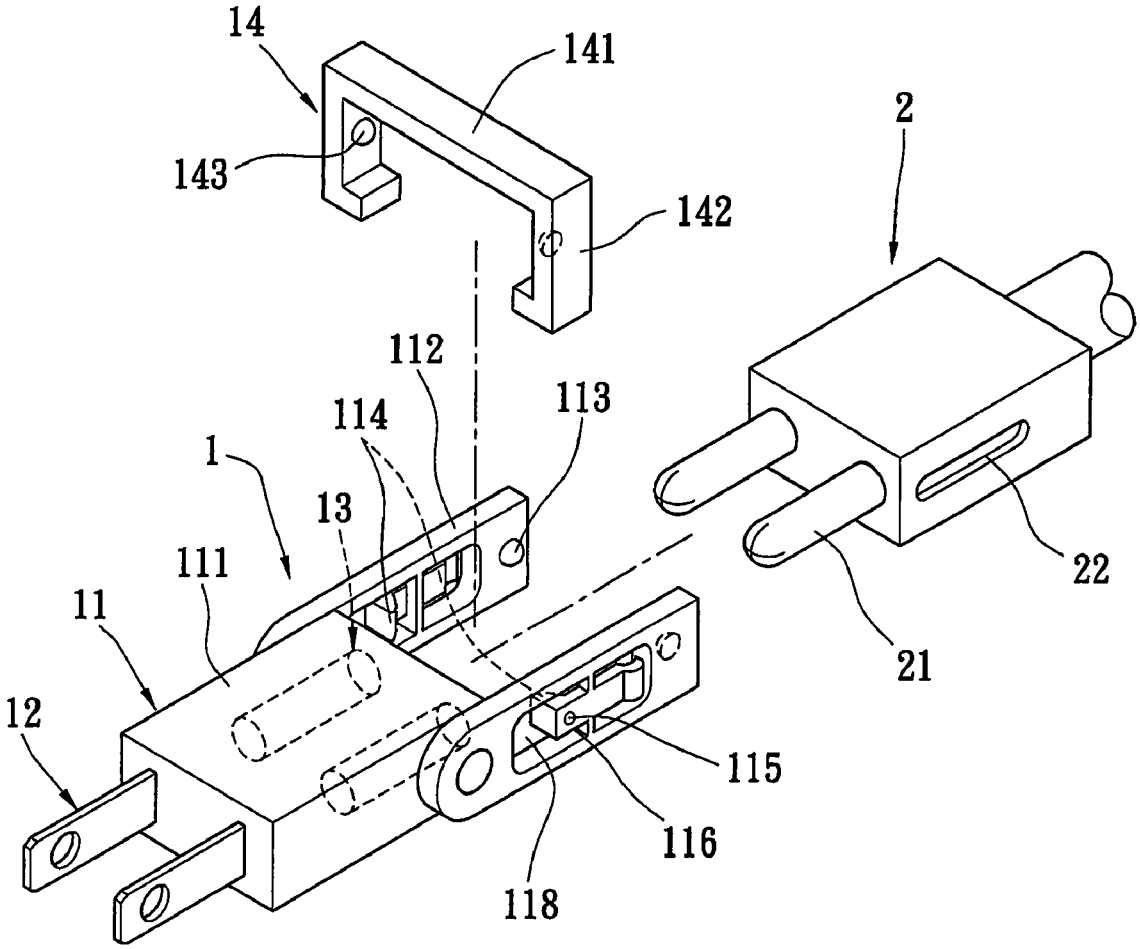
FIG. 11 is an exploded perspective view showing the sixth embodiment of the present invention.
Figure 12:
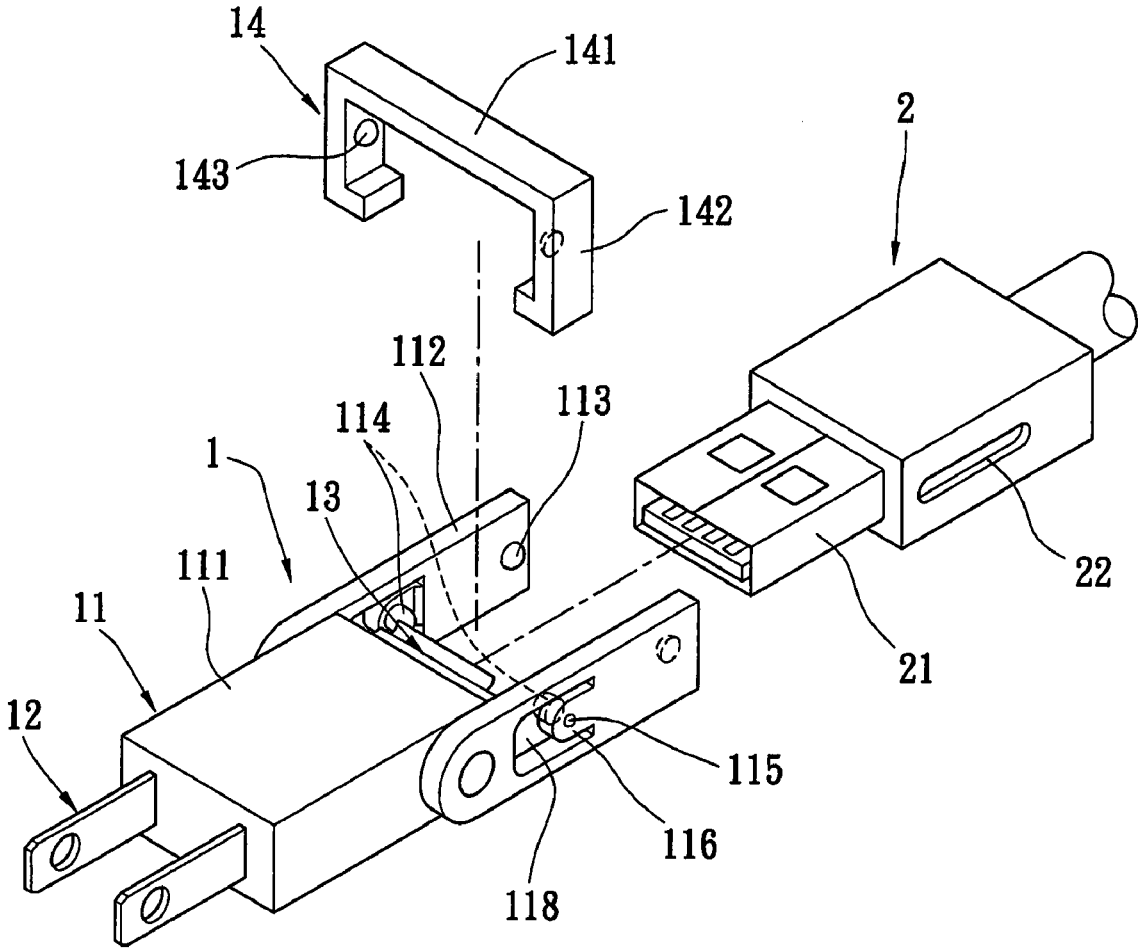
FIG. 12 is an exploded perspective view showing the seventh embodiment of the present invention.
Figure 13:
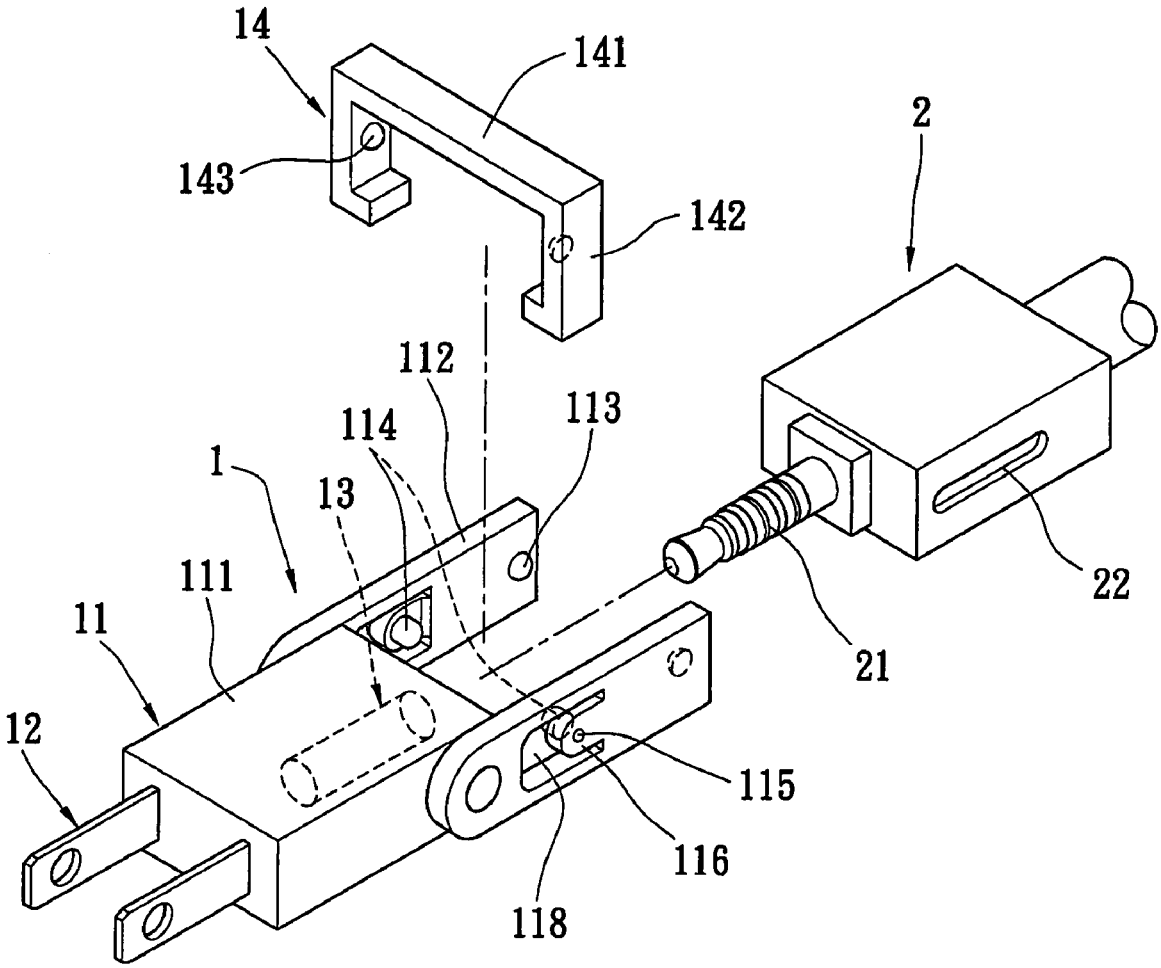
FIG. 13 is an exploded perspective view showing the eight embodiment of the present invention.
Figure 14:
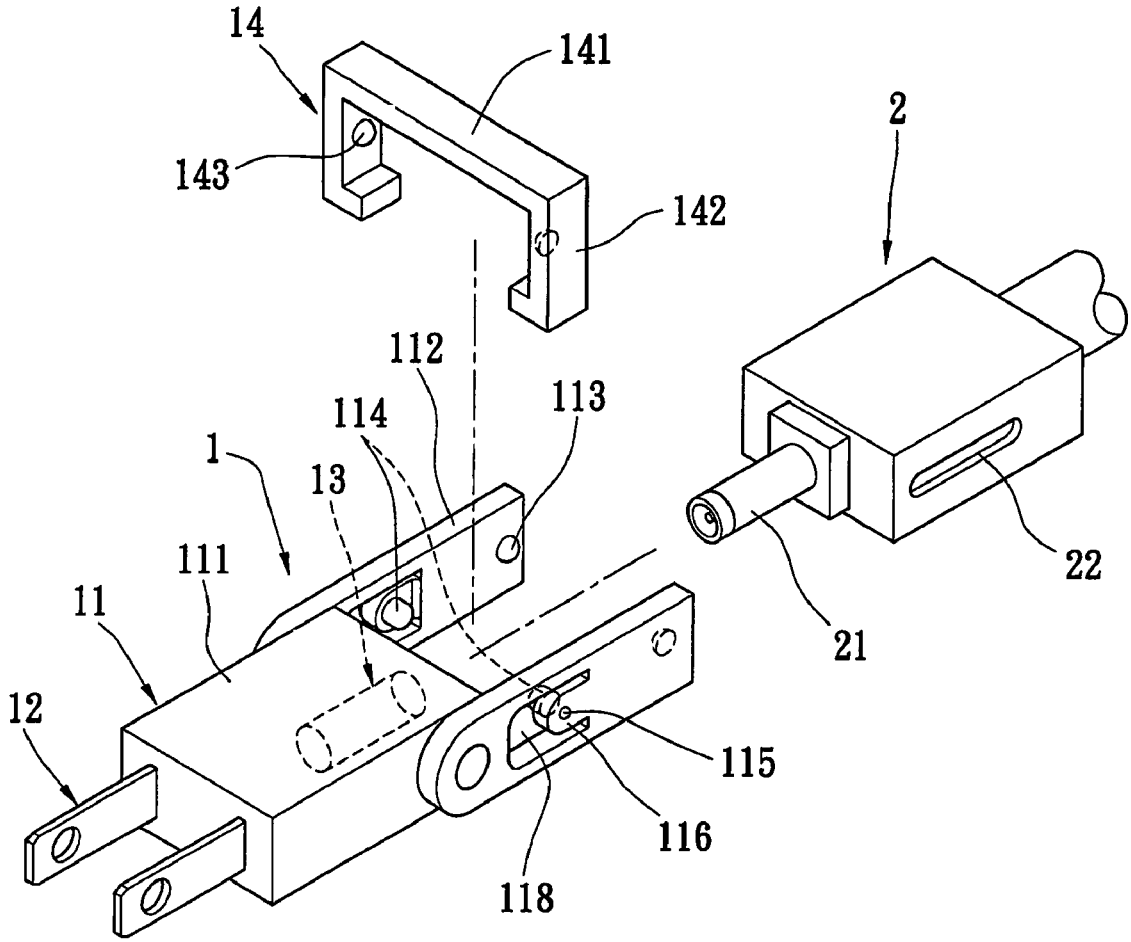
FIG. 14 is an exploded perspective view showing the ninth embodiment of the present invention.
Figure 15:
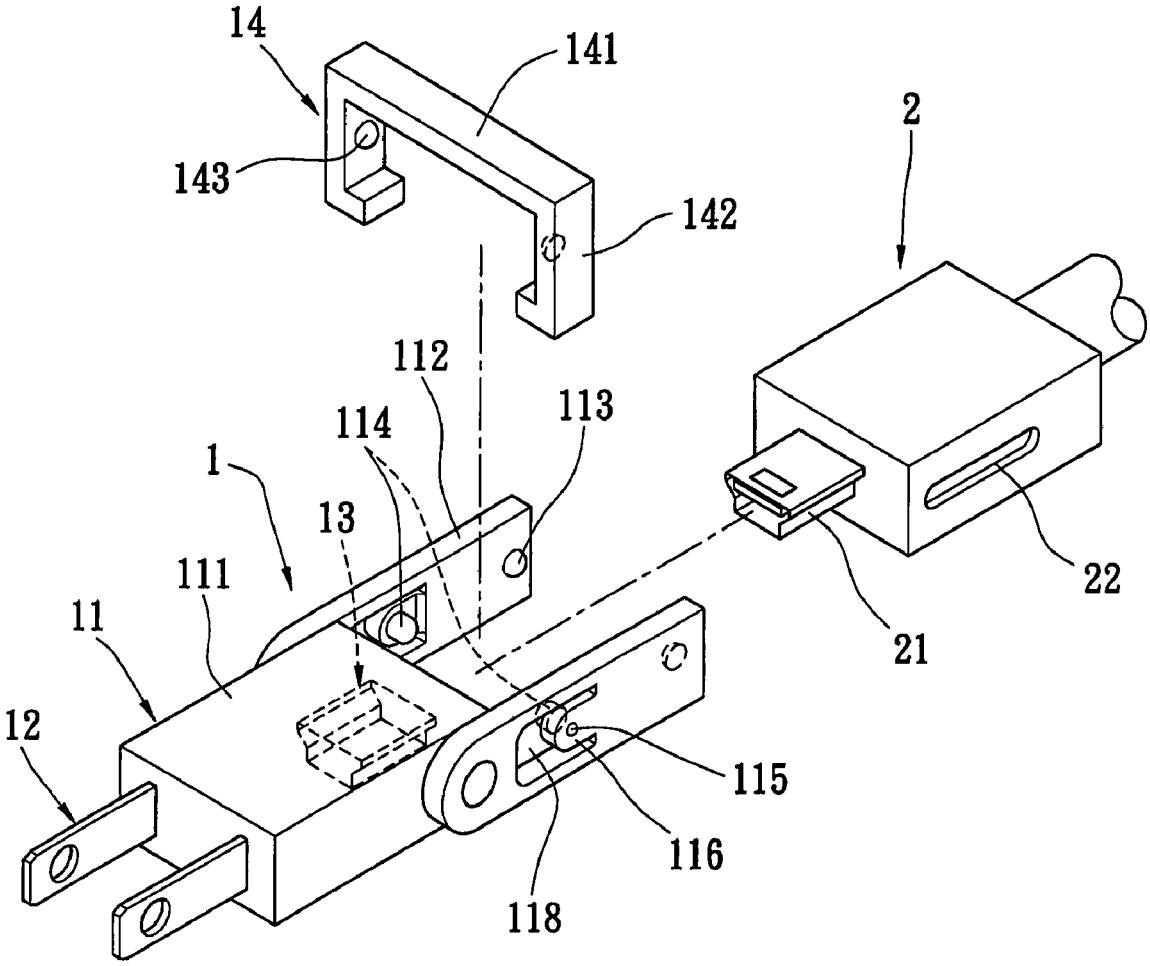
FIG. 15 is an exploded perspective view showing the tenth embodiment of the present invention.

Further, as shown in FIG. 11, in the present embodiment, the elastic arm 116 is formed into a different structure. The elastic arm 116 is fixed to the side arm 112 with its middle portion.

Further, as shown in FIGS. 12 to 15, the second connecting element 13 and the third connecting element 21 can be suitable plugs, sockets or connectors that can be correspondingly connected to each other, such as USB, AV, DC or HDMI.

Although the present invention has been described with reference to the foregoing preferred embodiments, it will be understood that the invention is not limited to the details thereof. Various equivalent variations and modifications may still occur to those skilled in this art in view of the teachings of the present invention. Thus, all such variations and equivalent modifications are also embraced within the scope of the invention as defined in the appended claims.

What is claimed is:

1. A modular plug device, comprising:

an adapter having an insulating casing and a locking button, the insulating casing having two side arms and being provided with pivoting portions, at least one side arm being provided with an elastic arm, the surface of the inner edge of the elastic arm being provided with a projecting portion, the locking button being movably provided on the two side arms, the surface of the inner edge of the locking button being provided with at least one abutting portion; and a plug movably assembled with the adapter, the side edges of the plug being formed with sliding grooves to correspond to the pivoting portions, the projecting portions being stopped and positioned by the front end of the sliding grooves when the abutting portions abut against the surface of the outer edge of the elastic arms.

2. The modular plug device according to claim 1, wherein the adapter further comprises a first connecting element and a second connecting element, the first and second connecting elements are oppositely connected into the insulating casing and electrically connected to each other, the front end of the plug is provided with a third connecting element for correspondingly connecting with the second connecting element.

3. The modular plug device according to claim 1, wherein the insulating casing has a body portion, the two side arms are connected to both sides of the body portion, respectively, and the projecting portions are provided on the surface of the inner edge of the elastic arms adjacent to the body portion.

4. The modular plug device according to claim 1, wherein the two side arms rotate or are immobile.

5. The modular plug device according to claim 1, wherein the thickness of the elastic arm is smaller than that of the side arm.

6. The modular plug device according to claim 1, wherein the locking button has a top plate and two side plates connected to both sides of the top plate, the two side plates are slidably connected to the two side arms, the abutting portion is provided on the surface of the inner edge of the top plate.

7. The modular plug device according to claim 1, wherein two locking buttons are provided, and the two locking buttons are movably provided on the two side arms.

8. The modular plug device according to claim 1, wherein at least one side arm is provided with a cut groove, and the abutting portion corresponds to the cut groove.

9. The modular plug device according to claim 8, wherein the cut groove is provided at the outer periphery of the elastic arm.

10. A modular plug device, comprising:

an adapter having an insulating casing, the insulating casing having two side arms and pivoting portions, the upper and lower edges of the two side arms connecting to a connecting plate respectively, the surface of the inner edge of at least one side arm being provided with a projecting portion; and a plug movably assembled with the adapter, the side edges of the plug formed with sliding grooves to correspond to the pivoting portions, the projecting portions being stopped and positioned by the front ends of the sliding grooves.

11. The modular plug device according to claim 10, wherein the adapter further comprises a first connecting element and a second connecting element, the first and second connecting elements are oppositely connected into the insulating casing and electrically connected to each other, the front end of the plug is provided with a third connecting element for correspondingly connecting with the second connecting element.

12. The modular plug device according to claim 10, wherein the insulating casing has a body portion, the two side arms and the two connecting plates are connected to both sides of the body portion, respectively, the projecting portions are provided on the surface of the inner edge of the elastic arm adjacent to the body portion.

* * * * *